United States Patent [19]

Holcombe et al.

[11] Patent Number: 4,929,799

[45] Date of Patent: May 29, 1990

[54] ISOMERIZATION PROCESS

[75] Inventors: Thomas C. Holcombe, South Salem; Thomas C. Sager, Mahopac; Warren K. Volles, Mount Kisco; Andrew S. Zarchy, Amawalk, all of N.Y.

[73] Assignee: UOP, Des Plaines, Ill.

[21] Appl. No.: 311,399

[22] Filed: Feb. 16, 1989

Related U.S. Application Data

[63] Continuation of Ser. No. 62,762, Jun. 15, 1987, abandoned.

[51] Int. Cl.[5] ..... C07C 9/14

[52] U.S. Cl. ..... 585/737; 585/738; 585/820; 585/826; 208/310 Z

[58] Field of Search ..... 208/310 Z; 585/820, 585/825, 734, 737, 738, 701, 826

[56] References Cited

U.S. PATENT DOCUMENTS

| | | | |
|---|---|---|---|
| 2,834,823 | 5/1958 | Patton et al. | 585/738 |
| 2,909,582 | 10/1959 | Bleich et al. | 585/738 X |
| 3,150,205 | 9/1964 | Krane et al. | 585/738 |
| 3,422,005 | 1/1969 | Avery | 208/310 |
| 4,210,771 | 7/1980 | Holcombe | 585/701 |
| 4,783,574 | 11/1988 | Barnes | 585/738 |

FOREIGN PATENT DOCUMENTS

| | | | |
|---|---|---|---|
| 1064056 | 10/1979 | Canada | 260/713.1 |
| 0224284 | 10/1986 | European Pat. Off. . | |

*Primary Examiner*—Glenn Caldarola

*Attorney, Agent, or Firm*—Thomas K. McBride; John G. Tolomei

[57] ABSTRACT

Processing and apparatus are provided for upgrading the octane of a mixed hydrocarbon gasoline feedstock by an integrated adsorption-isomerization process which catalytically isomerizes normal paraffinic hydrocarbons and concentrates non-normals in a product stream, in both the reactor-lead and adsorber-lead configuration.

The process includes passing an adsorber feed stream comprising hydrogen as well as hydrocarbons to an adsorbent bed to adsorb normal hydrocarbons. The hydrogen is preferably obtained from a hot hydrogen-containing process stream which is not cooled or separated into component parts prior to forming the adsorber feed. In some embodiments, the hot-hydrogen containing stream comes from reactor effluent and in others from desorption effluent.

According to the invention, the only hydrogen which will require cooling and separation from a hydrocarbon component is that which is recycled for desorption. The invention provides improved energy efficiency and can reduce equipment size and complexity.

29 Claims, 3 Drawing Sheets

ISOMERIZATION PROCESS

This application is a continuation of prior U.S. application Ser. No. 7/062,762, filed June 15, 1989, abandoned.

TECHNICAL FIELD

This invention relates to improvements in processing and apparatus for upgrading the octane of a mixed hydrocarbon gasoline feedstock by an integrated adsorption-isomerization process which catalytically isomerizes normal paraffinic hydrocarbons and concentrates non-normals in a product stream.

The known technology for improving the octane rating of certain hydrocarbon fractions, especially mixed feedstocks containing normal and iso pentanes and hexanes, typically involves isomerizing normal hydrocarbons in a feed stream prior to or following an adsorption-desorption cycle which isolates non-normals.

According to one widely used process, the entire feed is subjected to an initial catalytic reaction and then to a four-stage separation procedure employing molecular sieve adsorbers operating at essentially isobaric and isothermal conditions. Prior to the four-stage procedure, the reactor effluent is separated into an adsorber feed stream and a hydrogen-rich gas stream. The adsorber feed stream is passed to the adsorbers in two adsorption stages: the first, displacing void space gas from a prior desorption stage; and, the second, producing an adsorption effluent having a greatly reduced content of adsorbed (e.g., normal) hydrocarbons. The adsorbers are then desorbed with a hydrogen-rich gas stream in two stages: first to displace void space gas from the preceding adsorption stage; and, second to remove adsorbed hydrocarbons from the adsorbent. This is known as a reactor-lead process.

According to another known process, the feed is first passed to the adsorbers which immediately remove non-normals, again in a four-stage adsorption procedure. The normals from the second desorption stage are then mixed with sufficient hydrogen to protect the isomerization reactor and are then isomerized, with subsequent removal of newly-formed non-normals and recycle of normals to the reactor. This is known in the art as an adsorber-lead process.

By operating the four-stage adsorber cycle in the manner done in the prior art, substantially all hydrogen or other purge gas is removed from the adsorber feed prior to adsorption, and the adsorption effluent varies greatly in molecular weight, from about 10 lb/lb mole at the beginning of adsorption to about 70 lb/lb mole at the end. Because the heat exchange system must be adequate to operate at minimum heat content (i.e., lowest molecular weight), it has been necessary to exaggerate the size of the heat exchangers and to waste heat from the high heat content portion. It would be desirable to produce an adsorption effluent which showed less variation in molecular weight.

The adsorbers operate essentially as a batch procedure. To approach a continuous flow of adsorber effluent with a four-stage adsorber cycle, the prior art has typically employed four adsorbers operated in timed relationship. It would be desirable to reduce the capital cost of the adsorbers and related conduits, valves and controls.

While increasing adsorber operating pressure increases the partial pressure of normals and should, therefore, improve its adsorption, increasing the pressure in prior art adsorbers does not give the desired increase in adsorption efficiency. The adsorbers are filled with solid molecular sieve adsorbent and have significant void space volumes not occupied by solid material. Operating the adsorbers as in the prior art, but at increased pressures, has the disadvantage of increasing void space storage of gases being processed. It would be advantageous to achieve a better proportion of adsorbed normals to void space storage of hydrocarbon.

It would further be desirable to decrease the total adsorbent bed volume and to improve the energy efficiency in an integrated isomerization-adsorption process which could achieve total isomerization of all normal hydrocarbons.

Most preferably, it would be desirable to increase the degree of integration of the reactor and adsorber operations to save energy and decrease the amount of molecular sieve materials and vessel volumes required.

BACKGROUND ART

The art has produced a number of integrated isomerization-adsorption systems for isomerizing a feed stream containing normal and non-normal hydrocarbons and producing a product stream which is useful as a gasoline blending feedstock.

Most of the prior art systems totally isomerize the normals in the feed and are referred to in the art as total isomerization processes, i.e., TIP. Among these are reactor-lead systems, where the fresh feed and any recycle is fed to the isomerization reactor prior to separation of non-normals, and adsorber-lead systems, where the fresh feed is fed to the adsorbers prior to isomerization. As currently operated, both of these schemes typically employ three or four adsorber beds which are cycled through at least one adsorption stage and two desorption stages.

In Canadian Patent No. 1,064,056, Reber et al describe a total isomerization process wherein large fluctuations in the concentration of either n-pentane or n-hexane in the reactor feed are prevented by suitably controlling the operation of a three-bed adsorber system. According to the disclosure, no more than two beds are being desorbed at any given time and the terminal stage of desorption in one of the three beds is contemporaneous with the initial stage of desorption in another of the three beds.

Both adsorber-lead and reactor-lead processes are specifically exemplified. The adsorber-lead process calls for first separating hydrogen from the reactor effluent. Fresh feed is then combined with the reactor hydrocarbon effluent and the combined stream is passed through the adsorbers to remove non-normal hydrocarbons so that the feed to the reactor is essentially normal hydrocarbons. This requires heat exchange equipment of significant size to handle streams of widely varying molecular weight and large energy inputs to cool the entire reactor effluent to separate the hydrocarbon and hydrogen portion, and then to reheat both. The reactor-lead process is similar in this regard.

In U.S. Pat. No. 4,210,771, Holcombe describes a reactor-lead total isomerization process which reduces the recycle rate to the reactor while maintaining a sufficient reactor hydrogen partial pressure by reducing fluctuations in hydrocarbon flow rates to the reactor.

However, this reactor-lead process required cooling the entire reactor effluent to separate hydrogen from hydrocarbon portions prior to separating the normals from non-normals in a four-stage adsorption section.

The effluent from the isomerization reactor is condensed to separate a hydrocarbon fraction. This fraction is then reheated and passed as feed in the vapor state and at superatmospheric pressure periodically in sequence through each of at least four fixed beds of a system containing a zeolitic molecular sieve adsorbent having effective pore diameters of substantially 5 Angstroms, each of said beds cyclically undergoing the stages of:

A-1 adsorption-fill, wherein the vapor in the bed void space consists principally of a non-sorbable purge gas and the incoming feedstock forces the said non-sorbable purge gas from the bed void space out of the bed without substantial intermixing thereof with non-adsorbed feedstock fraction;

A-2 adsorption, wherein the feedstock is cocurrently passed through said bed and the normal constituents of the feedstock are selectively adsorbed into the internal cavities of the crystalline zeolitic adsorbent and the nonadsorbed constituents of the feedstock are removed from the bed as an effluent having a greatly reduced content of normal feedstock constituents;

D-1 void space purging, wherein the bed, which is loaded with normals adsorbate to the extent that the stoichiometric point of the mass transfer zone thereof has passed between 85 and 97 percent of the length of the bed and the bed void space contains a mixture of normals and non-normals in essentially feedstock proportions, is purged countercurrently, with respect to the direction of A-2 adsorption, by passing through the bed a stream of a non-sorbable purge gas in sufficient quantity to remove said void space feedstock vapors but not more than that which produces about 50 mole percent, preferably not more than 40 mole percent, of adsorbed feedstock normals in the bed effluent; and D-2 purge desorption, wherein the selectively adsorbed feedstock normals are desorbed as part of the desorption effluent by passing a non-sorbable purge gas countercurrently with respect to A-2 adsorption through the bed until the major proportion of adsorbed normals has been desorbed and the bed void space vapors consist principally of non-sorbable purge gas.

This process results in wide fluctuations in the molecular weight of the adsorption effluent, has considerable complexity and requires all recycled hydrocarbons and hydrogen to be cooled and reheated.

There is a present need for improvements in isomerization-adsorption systems which will reduce energy consumption while preferably reducing adsorber bed volume and the overall complexity of the adsorption section.

SUMMARY OF THE INVENTION

The present invention is based upon the discovery that considerable improvements can be achieved in terms of reduced adsorbent inventories, reduced adsorption section complexity, and improved energy efficiency, for an integrated isomerization-adsorption process for upgrading light naptha feeds by implementing changes which are contrary to conventional technology. The invention provides improved apparatus and methods for increasing the non-normal content of a feed stream containing normal and non-normal hydrocarbons by a new integration of isomerization and adsorption technologies in both the adsorber-lead and reactor-lead modes.

The process upgrades a hydrocarbon feed containing non-normal hydrocarbons and normal pentane and hexane to produce a hydrocarbon stream enriched in non-normals and includes: passing an adsorber feed stream, comprising hydrogen and hydrocarbons, to an adsorption section containing an adsorbent bed to adsorb normal hydrocarbons from said feed and to pass non-normal hydrocarbons and hydrogen out of the adsorption section as adsorption effluent; passing hydrogen-containing purge gas through said adsorbent bed containing adsorbed normal hydrocarbons to produce a desorption effluent comprising hydrogen and normal hydrocarbons; and passing at least a portion of said desorption effluent to an isomerization reactor to produce a reactor effluent comprising hydrogen and a reactor hydrocarbon component comprising an enhanced proportion of non-normal to normal hydrocarbons. The invention enables improved integration of the two technologies of isomerization and adsorption-desorption.

When operating in the reactor-lead mode, the adsorber feed stream comprises reactor effluent, preferably prior to any significant cooling or component separation. This supplies hydrogen to the adsorber bed and conserves the heat value of the hydrogen and hydrocarbon components. Additionally, this embodiment enables recycle of the majority of the hydrocarbon based on weight in a given cycle, without cooling to any significant degree. Preferably, the only hydrogen which will require cooling and separation from a hydrocarbon component is that which is recycled for desorption. The desorption effluent in this embodiment contains hot hydrogen and hydrocarbons and is preferably not cooled or fractionated prior to recycling for isomerization of normal hydrocarbons. This embodiment can be effectively carried out by placing the isomerization catalyst and the molecular sieve adsorbent in the same vessel.

When operating in the adsorber-lead mode, the adsorber feed stream comprises fresh hydrocarbon feed and recycle, comprising hydrogen and hydrocarbons, from the reactor. The recycle from the reactor is preferably reactor effluent taken off directly without significant cooling or component separation. This hot recycle provides hydrogen to the adsorbent bed and conserves the heat value of the hydrogen and hydrocarbon components.

The apparatus of the invention provides means for performing the above processes.

BRIEF DESCRIPTION OF THE DRAWINGS

The invention will be better understood and its advantages will be more apparent from the following brief description when read in connection with the accompanying drawings wherein.

SUITABLE FEEDSTOCKS (FRESH FEED)

Figure 1:
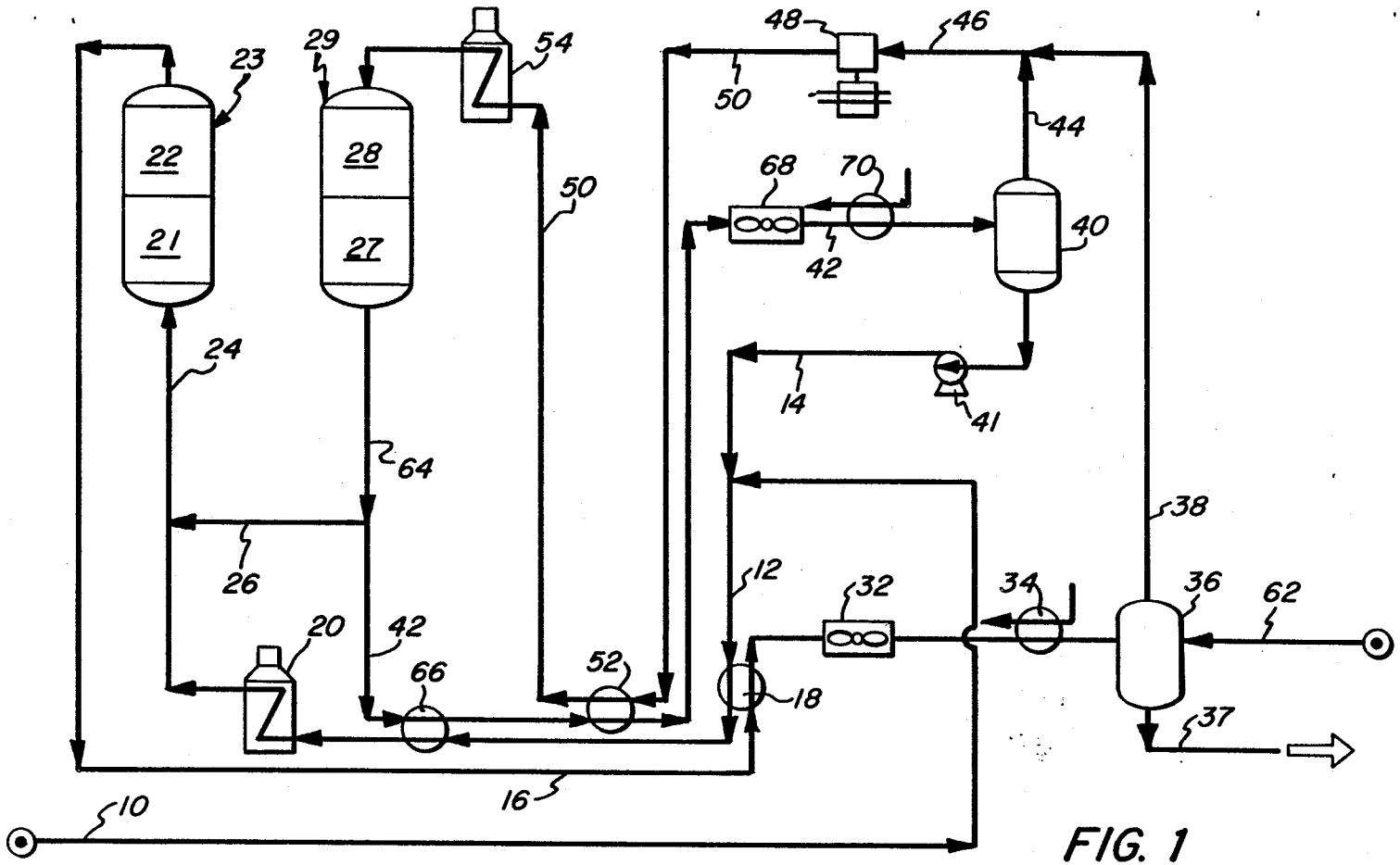
FIG. 1 is a schematic of a reactor-lead process and an apparatus arrangement which employs two pairs of reactor and adsorber sections wherein each reactor/adsorber pair is in a single vessel.

The fresh feed contains normal and non-normal hydrocarbons. It is composed principally of the various isomeric forms of saturated hydrocarbons having from five to six carbon atoms. The expression "the various isomeric forms" is intended to denote all the branched chain and cyclic forms of the noted compounds, as well as the straight chain forms. Also, the prefix notations "iso" and "i" are intended to be generic designations of all branched chain and cyclic (i.e., non-normal) forms of the indicated compound.

The following composition is typical of a feedstock suitable for processing according to the invention:

| Components | Mole % |
|---|---|
| $C_4$ and lower | 0–7 |
| i-$C_5$ | 10–40 |
| n-$C_5$ | 5–30 |
| i-$C_6$ | 10–40 |
| n-$C_6$ | 5–30 |
| $C_7$ and higher | 0–10 |

Suitable feedstocks are typically obtained by refinery distillation operations, and may contain small amounts of $C_7$ and even higher hydrocarbons, but these are typically present, if at all, only in trace amounts. Olefinic hydrocarbons are advantageously less than about 4 mole percent in the feedstock. Aromatic and cycloparaffin molecules have a relatively high octane number. Accordingly, the preferred feedstocks are those high in aromatic and cycloparaffinic hydrocarbons, e.g., at least 5, and more typically from 10 to 25 mole percent of these components combined.

The non-cyclic $C_5$ and $C_6$ hydrocarbons typically comprise at least 60, and more typically at least 75, mole percent of the feedstock, with at least 25, and preferably at least 35, mole percent of the feedstock being hydrocarbons selected from the group of iso-pentane, iso-hexane and combinations of these. Preferably, the feedstock will comprise no more than 40, and more preferably no more than 30 mole percent of a combination of n-pentane and n-hexane.

SUITABLE ISOMERIZATION CATALYSTS

The isomerization reactor sections (21 and 27 in FIG. 1) contain an isomerization catalyst which can be any of the various molecular sieve based catalyst compositions well known in the art which exhibit selective and substantial isomerization activity under the operating conditions of the process. As a general class, such catalysts comprise the crystalline zeolitic molecular sieves having an apparent pore diameter large enough to adsorb neopentane, $SiO_2/Al_2O_3$ molar ratio of greater than 3; less than 60, preferably less than 15, equivalent percent alkali metal cations and having those $AlO_4$—tetrahedra not associated with alkali metal cations either not associated with any metal cation, or associated with divalent or other polyvalent metal cations.

Because the feedstock may contain some olefins and will undergo at least some cracking, the zeolitic catalyst is preferably combined with a hydrogenation catalyst component, preferably a noble metal of group VIII of the Periodic classification of the Elements. The catalyst composition can be used alone or can be combined with a porous inorganic oxide diluent as a binder material. The hydrogenation agent can be carried on the zeolitic component and/or on the binder. A wide variety of inorganic oxide diluent materials are known in the art—some of which exhibit hydrogenation activity per se. It will, accordingly, be understood that the expression "an inorganic diluent having a hydrogenation agent thereon" is meant to include both diluents which have no hydrogenation activity per se and carry a separate hydrogenation agent and those diluents which are per se hydrogenation catalysts. Oxides suitable as diluents, which of themselves exhibit hydrogenation activity, are the oxides of the metals of Group VI of the Mendeleev Periodic Table of Elements. Representative of the metals are chromium, molybdenum and tungsten.

It is preferred that the diluent material possess no pronounced catalytic cracking activity. The diluent should not exhibit a greater quantitative degree of cracking activity than the zeolitic component of the overall isomerization catalyst composition. Suitable oxides of this latter class are the aluminas, silicas, the oxides of metals of Groups III, IV-A and IV-B of the Mendeleev Periodic Table, and cogels of silica and oxides of the metals of the Groups III, IV-A and IV-B, especially alumina, zirconia, titania, thoria and combinations thereof. Aluminosilicate clays such as kaolin, attapulgite, sepiolite, polygarskite, bentonite, montmorillonite, and the like, when rendered in a pliant plastic-like condition by intimate admixture with water are also suitable diluent materials, particularly when said clays have not been acid-washed to remove substantial quantities of alumina.

Suitable catalysts for isomerization reactions are disclosed in detail in U.S. Pat. Nos. 3,236,761 and 3,236,762. A particularly preferred catalyst is one prepared from a zeolite Y (U.S. Pat. No. 3,130,007) having a $SiO_2/Al_2O_3$ molar ratio of about 5 by reducing the sodium cation content to less than about 15 equivalent percent by ammonium cation exchange, then introducing between about 35 and 50 equivalent percent of rare earth metal cations by ion exchange and thereafter calcining the zeolite to effect substantial deammination. As a hydrogenation component, platinum or palladium in an amount of about 0.1 to 1.0 weight percent, can be placed on the zeolite by any conventional method. The disclosures of these above-cited U.S. patents are incorporated herein by reference in their entireties.

SUITABLE ADSORBENTS

The zeolitic molecular sieve employed in the adsorption bed must be capable of selectively adsorbing the normal paraffins of the feedstock using molecular size and configuration as the criterion. Such a molecular sieve should, therefore, have an apparent pore diameter of less than about 6 Angstroms and greater than about 4 Angstroms. A particularly suitable zeolite of this type is zeolite A, described in U.S. Pat. No. 2,883,243, which in several of its divalent exchanged forms, notably the calcium cation form, has an apparent pore diameter of about 5 Angstroms, and has a very large capacity for adsorbing normal paraffins. Other suitable molecular sieves include zeolite R, U.S. Pat. No. 3,030,181; zeolite T, U.S. Pat. No. 2,950,952, and the naturally occurring zeolitic molecular sieves chabazite and erionite. These U.S. patents are incorporated by reference herein in their entireties.

The term "apparent pore diameter" as used herein may be defined as the maximum critical dimension, or the molecular species which is adsorbed by the adsorbent under normal conditions. The critical dimension is defined as the diameter of the smallest cylinder which will accommodate a model of the molecule constructed using the available values of bond distances, bond angles and van der Waals' radii. The apparent pore diameter will always be larger than the structural pore diameter, which can be defined as the free diameter of the appropriate silicate ring in the structure of the adsorbent.

DETAILED DESCRIPTION

The invention will be described primarily according to a preferred embodiment wherein a mixed hydrocarbon feedstock (fresh feed) is upgraded for use as a gasoline blending stock by an integrated combination of adsorption and isomerization.

The invention will first be described in terms of the reactor-lead configuration in conjunction with FIG. 1 which, as a virtual total integration of isomerization and adsorption technologies, enables adsorber and reactor beds to be in the same vessel. This configuration combines the benefits of both reactor-lead and adsorber-lead systems. Normals in the feed can be partially isomerized before adsorption as in the reactor-lead system, thereby making the adsorption section smaller. On desorption, the benefits of adsorber-lead are appreciated. Since essentially normals are fed to the reactor section on desorption, the catalyst volume is utilized more effectively.

Referring to FIG. 1, fresh feed in line 10 is combined in line 12 with hydrocarbon recycle from line 14. This combined hydrocarbon stream is heated by indirect heat exchange with adsorption effluent, carried by line 16 in heat exchanger 18 from which it is passed to furnace 20 where it is heated sufficiently for passage to isomerization reactor section 21 (catalyst bed) and then the adsorption section 22 (adsorbent bed), of vessel 23. It is of course possible to have the catalyst and adsorbent beds in different vessels if desired.

The reactor feed stream in line 24 is formed by combining the hot hydrocarbon stream from furnace 20 with hot reactor effluent from line 26 which contains hydrogen and hydrocarbon components (i.e., hot recycle or hot hydrogen recycle). Suitable control valves and controllers (not shown) direct feed stream 24 to the appropriate one of vessels 23 and 29, which will alternate between the two functions now represented in FIG. 1 as being performed by each of the vessels.

Depending on the particular catalyst composition employed, the operating temperature of within vessels 23 and 29 is generally within the range of 100° to 390° C. and the pressure is within the range of 175 to 600 psia. Desirably, the temperature will be within the range of from 220° to 280° C. and the pressure will be in the range of from 200 to 400, preferably 220 to 300 psia, and most preferably about 250 psia. The catalyst bed is maintained under a hydrogen partial pressure sufficient to prevent coking of the isomerization catalyst at the conditions maintained in the reactor. Typically, the hydrogen partial pressure will be within the range of from 100 to 250, preferably from 130 to 190, psia with the hydrogen, comprising from 10 to 90, preferably from 35 to 75 and most preferably from 45 to 65, mole percent of the reactor contents which are maintained in a gaseous state.

The feed to the reactor will contain, in addition to hydrogen and hydrocarbon reactants, e.g., normal and iso-pentane and hexane, a quantity of light hydrocarbons which are produced during the reaction and possibly as part of feed and makeup. Because these are nonsorbable, they are retained in the process at some equilibrium level and circulate with the recycle stream.

Preferably, the adsorbents in adsorbent beds 22 and 28 have effective pore diameters of substantially 5 Angstroms. The term "bed void space" for purposes of this description means any space in the bed not occupied by solid material except the intracrystalline cavities of the zeolite crystals. The pores within any binder material which may be used to form agglomerates of the zeolite crystals is considered to be bed void space. The two adsorbent beds shown in the system of FIG. 1, each cyclically undergo the two stages of:

ADS—The feed is intentionally mixed with hydrogen prior to introducing it to the feed end of the adsorber, then adsorbed, with product and hydrogen being withdrawn from the effluent end of the adsorber. The hydrogen will typically comprise from 10 to 90 mole percent of the adsorber feed, preferably, from 35 to 65; and most preferably, from 45 to 55 mole percent. Since there is hydrogen present in the feed as well as the product, there is proportionally less variation in the molecular weight of the product and therefore more efficient heat exchange. (There is no A1 step.)

DES—hydrogen is used to desorb the bed in a direction countercurrent to the feed and the total effluent is sent to the isomerization reactor as feed with no internal recycle. (There is no $D_1$ step.)

The presence of hydrogen in the adsorber feed improves heat exchange. Heat exchange is better for a steady state system than a dynamic system such as conventional TIP. The heat content of a process stream such as the adsorption effluent is a function of the molecular weight of the stream, which varies from about 10 lb/lb mole at the beginning of the step to about 70 lb/lb mole at the end of the step in the standard conventional TIP process. Since the heat exchange system must be designed to operate at the minimum heat content level, a significant amount of the high heat content portion cannot be utilized effectively. In the present invention, the molecular weight of the adsorption effluent varies from about 10 to 40 lb/lb mole.

In a steady state system there would be no variation in molecular weight. Hence, a mathematical relationship showing the approach to a steady state system ca be developed as follows:

$$\% SS = (AMW - \text{Deviation from } AMW)/AMW$$

where,

AMW = average molecular weight

Deviation from AMW = (Maximum molecular weight − AMW)

For the standard conventional TIP the % SS is calculated as follows:

$$\% SS = (40 - (70 - 40))/40 = 25\%$$

Similarly, for the present invention the % SS is:

$$\% SS = (25 - (40 - 25))/25 = 40\%$$

It can be seen that the 40% value for the present invention system is significantly closer to the theoretical steady state value of 100% than the standard conventional value of 25%.

The invention also provides better adsorber and reactor integration which results in further advantages. Although it is clear that the number of adsorbers in the present invention is advantageously reduced from 4 to 2, it is not obvious why the adsorbent inventory is lower, and why the integration of the adsorber and catalyst is necessarily better in light of the increased flow to the catalyst section.

The adsorbent inventory of the present invention is lower than for an equivalent standard conventional TIP system because there are less normal paraffins processed through the adsorbers. In a conventional TIP system, the D1 step (initial part of desorption) performs two functions: one is to prevent hydrogen lean desorption effluent from contacting the catalyst, and the other is to recycle the D1 effluent back to the adsorbers for readsorption. The effect is to maximize the adsorber size and minimize the reactor size. In the present invention, the portion of the desorption effluent that would be D1 is passed directly to the isomerization reactor where it is further isomerized and then recycled back to the adsorbers. Hence, since the effluent has been further isomerized before being recycled to the adsorbers, fewer normals are ultimately recycled and the adsorbent inventory can be lower.

Since there is hydrogen present in the adsorber feed, and since adsorber capacity is a function of the normals partial pressure in the feed, it would be expected that the adsorber capacity should be slightly lower in the present invention (the effect is slight because at the normal partial pressures of the two cases, at greater than 50 psia, the adsorbent loading is about 90% of total capacity). However, this can be compensated for by operating the adsorbers at a higher pressure in order to increase the normals partial pressure. In fact, higher pressure operation is an advantage in the present invention but cannot conveniently be utilized in the conventional TIP system. In the conventional TIP system, an increase in operating pressure would result in only a marginal increase in adsorption capacity but would substantially increase the unwanted void space storage since it is directly proportional to the total pressure. Further, an increase in operating pressure would require a corresponding increase in operating temperature in order to prevent condensation. In the present invention, an increase in operating pressure is desirable since it increases the normals partial pressure so as to be comparable to the conventional TIP system; however, since the hydrogen is present, the pressure increase does not have as great a detrimental effect on void storage. In addition, a corresponding temperature increase would not be required since the condensation temperature is much lower for the hydrogen-containing feed.

The catalyst volume in a conventional TIP system is calculated as a function of the average feed rate in weight units. Since the initial portion of the desorption effluent, D1 effluent, is recycled to the adsorbers before being fed to the reactor, the average flow rate for the conventional TIP system is lower than for the present invention. It would be expected that the catalyst volume required should be proportionally higher for the present invention. However, a smaller than expected catalyst volume can be effectively used in the present invention because of the high isomer content of the initial portion of the desorption effluent. That is, some portion of the initial effluent can be passed through at a feed rate higher than usual since it is already partially isomerized. The remainder of the desorption effluent, which is low in isomer content, can be passed through the reactor at a more typical feed rate. The net result is that even though the reactor feed rate is significantly higher in the present invention, the increase in catalyst volume is not proportional since the invention makes it possible to utilize the high isomer/high flow rate portion of the desorption effluent more effectively than in conventional TIP.

The following description details an operation wherein bed 22 is undergoing adsorption, and bed 28, desorption. The reactor feed from line 24 is directed via suitable lines, manifolds, and valves (not shown) to vessel 23 for isomerization in catalyst bed 21 to produce a reactor effluent enriched in non-normals which is passed to adsorbent bed 22 undergoing adsorption. Each of the adsorbent beds in the system, namely beds 22 and 28 contain a molecular sieve adsorbent in a suitable form such as cylindrical pellets.

At the time that reactor effluent from catalyst bed 21 starts entering adsorbent bed 22, the bed contains residual purge gas from the preceding desorption stroke. The purge gas is preferably hydrogen-containing because of the need to maintain at least a minimum hydrogen partial pressure in the isomerization reactor. This is supplied to the adsorbent beds during desorption as a purge gas recycle stream via line 50. Feed through line 24 first flushes bed 22 of residual hydrogen-containing purge gas. This does not, however, end the stage and reactor effluent from bed 21 continues to flow as adsorber feed to adsorbent bed 22 with the production of adsorption effluent drawn off via line 16.

As adsorption continues, the normal paraffins in the feed are adsorbed by bed 22, and an adsorption effluent, i.e., hydrogen and the non-adsorbed non-normals, emerges from the bed through suitable valves and manifold arrangement (not shown). The adsorption effluent flows through line 16, heat exchanger 18, air cooler 32 and heat exhanger 34 prior to separation into a hydrogen-containing overhead product for recycle and an isomerate product in separator 36.

The overhead gas is recovered by separator 36 and combined with a similar overhead product from separator 40 which separates the reactor effluent takeoff from reactor bed 27 in line 42 into an overhead product taken off by line 42 and a reactor hydrocarbon product which is withdrawn via line 14 as described above. The combined stream formed from lines 38 and 44 is fed via line 46 to recycle compressor 48 for return via line 50 to the vessel having the adsorbent bed undergoing desorption. In this case appropriate valves direct flow to to heat exchanger 52 and heater 54 prior to entering vessel 29, containing bed 28 for desorption.

The effluent from bed 28, passes directly to reactor bed 27. During the desorption stage, void space adsorber feed is first purged, followed by desorption of selectively-adsorbed normal paraffins from the zeolitic molecular sieve. The desorption effluent from bed 28 will, throughout the stage, comprise hydrogen and hydrocarbons. The desorption effluent passes directly to isomerization reactor bed 27 as reactor feed.

The foregoing description is for a single stage of a total two stage cycle for the system. For the next stage, appropriate valves are operated so that vessel 29, containing catalyst bed 27 and adsorbent bed 28 receives feed to the reactor bed which passes reactor effluent to bed 28 for adsorption, and bed 22 in vessel 23 begins desorption with the desorption effluent passing directly to catalyst bed 21. At the end of two stages, both adsorbent beds have gone through the stages of adsorption and desorption.

The isomerization process will result in some hydrogen losses from the purge gas due to hydrogenation of starting materials and cracked residues. Hydrogen will also be lost due to solubility in product, and possibly a vent from line 50 (not shown) which can be controlled by suitable valve means. These losses require the addition of makeup hydrogen. Makeup hydrogen can be supplied in impure form, e.g., via line 62, typically as an offgas from catalytic reforming or steam reforming of methane. These hydrogen sources are suitably pure for isomerization processes which typically have a vent from the recycle stream. Refinery streams of lesser purity may also be satisfactory. The desorption effluent in line 58 will comprise desorbed normal hydrocarbons, e.g., n-pentane and n-hexane, and hydrogen and light hydrocarbon and other impurities which comprise the purge gas used for desorption. This effluent is reactor feed and is passed to isomerization reactor 60.

A portion (up to 100%) of the reactor effluent from bed 27 is split off from line 64 via line 26 as a hot hydrogen-containing stream (i.e., hot recycle or hot-hydrogen recycle) for feed to the vessel 23, first to reactor bed 21 and then to adsorbent bed 22 undergoing adsorption. Preferably, at least 10% and most preferably from 25 to 75%, on a weight basis, will be recycled to the first reactor in this manner. The remainder of the reactor effluent is passed to heat exchanger 66 where its sensible heat is used to heat the combined hydrocarbon stream in line 12 which includes fresh feed. From the heat exchanger 66, reactor effluent in line 42 is further cooled by air cooler 68 and water cooler 70 prior to separation as discussed above in separator 40.

The advantages of this invention can be appreciated in a number of ways. An important concept in all of the schemes is that some or all of the hydrogen used in the desorption step is fed to an adsorber bed undergoing adsorption as hot recycle from either the reactor effluent or the desorption effluent, depending on the particular configuration used. The term, hot recycle or hot-hydrogen recycle, means hydrogen-rich gas which has been previously heated for some purpose and is utilized a second time to improve the thermal efficiency of the process. It should also be noted that the invention also applies to the partial recycle process as described in the U.S. Pat. No. 4,709,116, issued Nov. 24, 1987 the disclosure of which is hereby incorporated by reference.

As discussed above this hot recycle does not involve a component separation; it is simply a stream or stream division. One of its major functions is to provide the necessary hydrogen in the adsorption step to prevent catalyst coking when the desorption effluent is passed to the reactor. In addition to providing the necessary hydrogen, the hot recycle carries with it a substantial portion of the reactor effluent that must ultimately be recycled to the adsorbers. This mode of operation reduces the process cooling and heating requirements that would otherwise be required. It is important to note that the amount of hot recycle must be balanced between maximizing the amount of hydrocarbon reactor effluent recycled and minimizing the amount of hydrogen recycled. (Maximizing the hydrocarbon recycle reduces energy consumption and minimizing hydrogen recycle increases the adsorption capacity.)

This hot recycle is different than the D1 recycle used in the conventional TIP. It is undesirable to have hydrogen present in the D1 effluent whereas in the present invention its primary purpose is to provide hydrogen. In addition, the hot recycle in the embodiments of FIGS. 1, 2 and 4 of the present invention originates from the reactor and not from the adsorbers as in the conventional TIP. This step is likewise different from the reactor effluent recycle used in the noted partial recycle process and conventional TIP since the purpose of those steps is to recycle a hydrogen-free adsorber feed.

Figure 2:
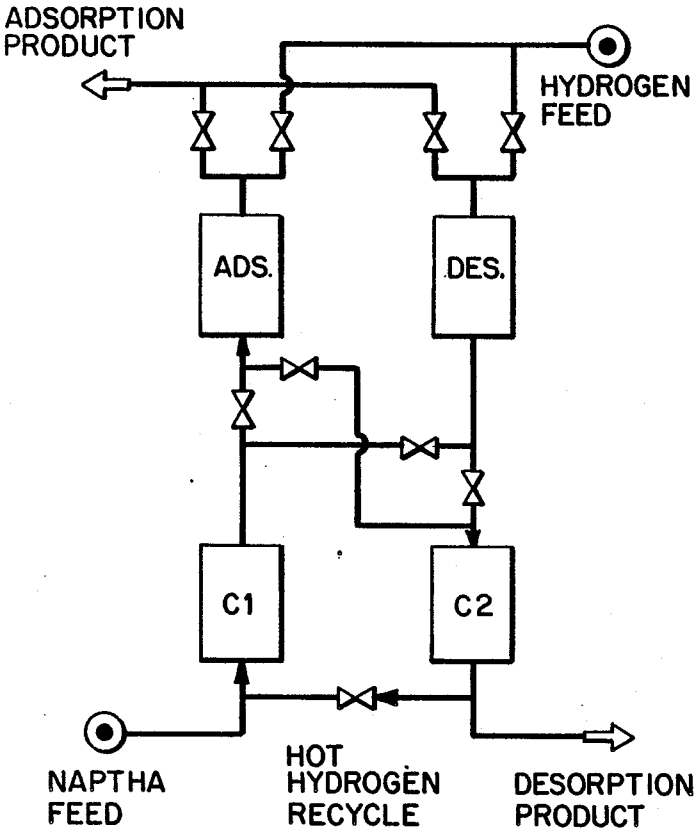
FIG. 2 is a simplified schematic of a variation on the embodiment of FIG. 1, which employs a valve manifold to maintain the same direction of flow throughout a cycle.

Considering the reactor-lead configuration, at least two more variations are possible. In certain cases it may be more beneficial to maintain the flow through the catalyst (beds C1 and C2) in one direction rather than alternating between both directions as described in the configuration of FIG. 1. FIG. 2 illustrates one way that this can be accomplished with a simple valve manifold, which alternates the flow through beds C1 and C2 but maintains flow in the same direction through adsorbent beds ADS and DES. Other methods such as a side draw port might be feasible when a compound bed as in FIG. 1 is used.

Figure 3:
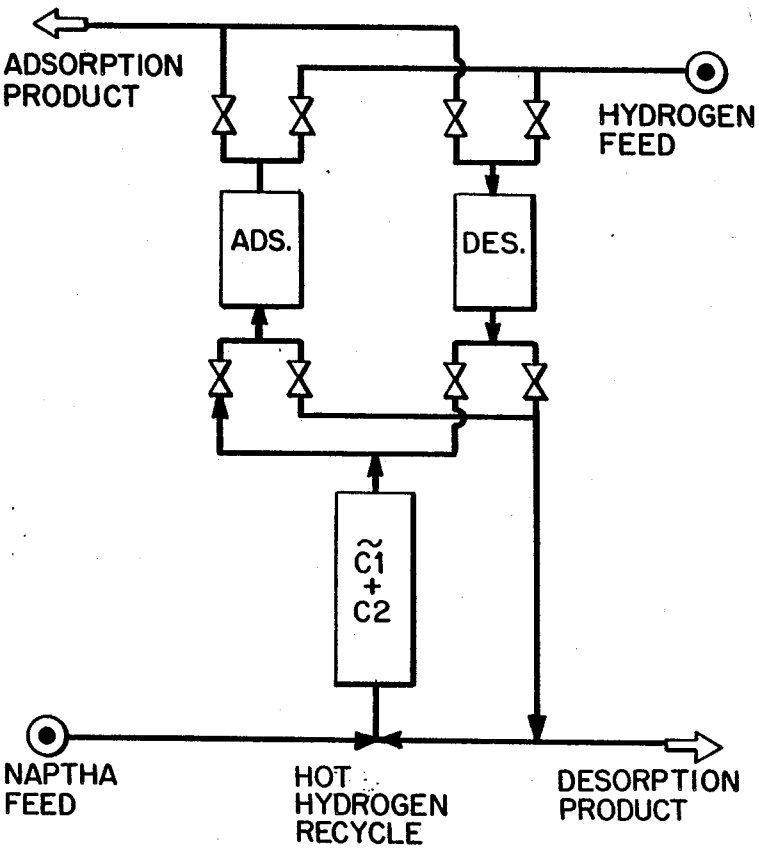
FIG. 3 is another embodiment of a reactor-lead process and apparatus of the invention employing a single reactor vessel.

A third variation of the reactor lead configuration is to combine the two reactor sections (C1 and C2) in a single vessel. This scheme might be used if it would be impractical, for some reason, to utilize the compound bed approach. FIG. 3 shows that there is one feed pass through the larger reactor, followed by adsorption (ADS) then desorption (DES) with hydrogen. In this case, the hot hydrogen recycle is provided by the desorption effluent and not the reactor effluent.

Figure 4:
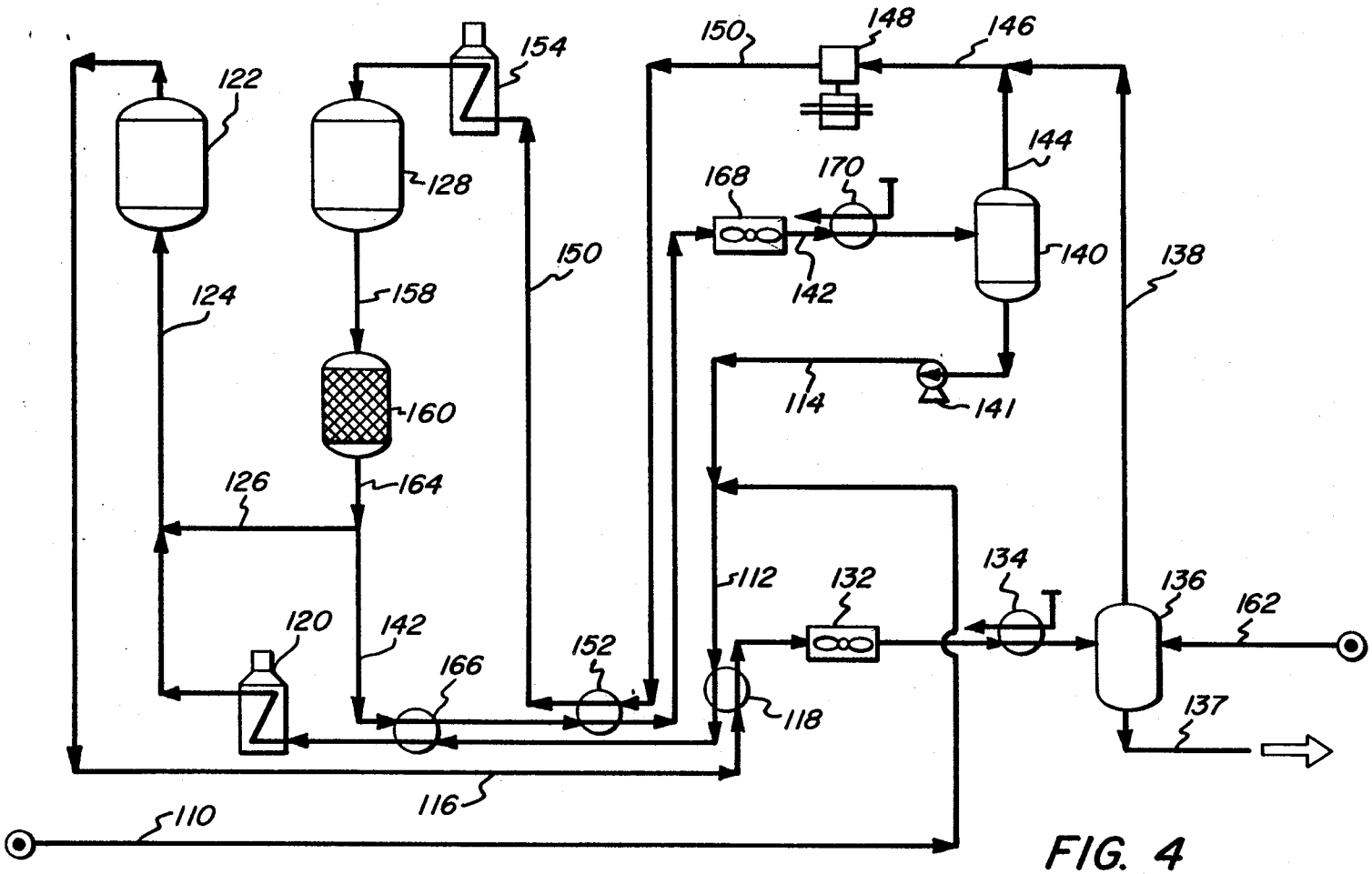
FIG. 4 is a schematic of an adsorber-lead process and apparatus arrangement according to the invention wherein a portion of the isomerization reactor effluent is combined with hydrocarbons from fresh feed and recycle to form an adsorber feed.

FIG. 4 shows an adsorber-lead configuration which achieves the advantages of the invention and is characterized by a two stage adsorber cycle and the use of a hot hydrogen recycle which employs reactor effluent, without substantial cooling or separation of components, as a portion of adsorber feed. Fresh feed in line 110 is combined in line 112 with reactor hydrocarbon product from line 114. This combined hydrocarbon stream is heated by indirect heat exchange with adsorption effluent, carried by line 116 in heat exchanger 118 from which it is passed to furnace 120 where it is heated sufficiently for passage to the adsorption section 122.

The adsorber feed stream in line 124 is formed by combining the hot hydrocarbon stream from furnace 120 with hot reactor effluent from line 126 which contains hydrogen and hydrocarbon components. Suitable control valves and controllers (not shown) direct the adsorber feed stream directed to the appropriate bed in the adsorption section (shown here as bed 122).

The adsorber feed, containing normal and non-normal hydrocarbons in the vapor state, is passed at superatmospheric pressure periodically in sequence through each of a plurality of fixed adsorber beds, e.g., two as shown in FIG. 4. It is of course possible to employ a greater number of beds if desired; however, it is an advantage of the invention that only two are required. In a two bed system, each of the beds cyclically undergoes the two stages (ADS and DES) described with reference to FIG. 1.

Referring again to the adsorption section in particular, the following description details an operation wherein bed 122 is undergoing adsorption, and bed 128, desorption. A portion of the adsorber feed from line 124 is directed via suitable lines, manifolds, and valves to adsorbent bed 122 undergoing adsorption.

Flow of the adsorber feed through line 124 first flushes bed 122 of residual hydrogen-containing purge gas, and adsorber feed continues to flow to adsorbent bed 122 with the production of adsorption effluent drawn off via line 116.

As adsorption continues, the normal paraffins in the feed are adsorbed by bed 122, and an adsorption effluent, i.e., hydrogen and the non-adsorbed non-normals, emerges from the bed through suitable valves and manifold arrangement (not shown). The adsorption effluent flows through line 116, heat exchanger 118, air cooler 132 and heat exhanger 134 prior to separation into a hydrogen-containing overhead product for recycle and an isomerate product in separator 136.

The overhead gas can be recovered by separator 136 is combined with a similar overhead product from separator 140 which separates the reactor effluent takeoff in line 142 into an overhead product recovered in line 144 and a reactor hydrocarbon product which is withdrawn via line 114 as described above. The combined stream formed from lines 138 and 144 is fed via line 146 to recycle compressor 148 for return to the adsorber section via line 150 for desorption of bed 128.

From compressor 148, the hydrogen-containing purge gas stream is passed via line 150 to heat exchanger 152 and heater 154, wherein it is heated and then passed to bed 128 which is undergoing desorption.

The effluent from bed 128, passes through suitable valves and manifold (not shown) to reactor 160 via line 158. During the desorption stage, void space adsorber feed is first purged, followed by desorption of selectively-adsorbed normal paraffins from the zeolitic molecular sieve. The desorption effluent from bed 128 will, throughout the stage, comprise hydrogen and hydrocarbons. The desorption effluent is sent to isomerization reactor 160 via line 158 as reactor feed.

The foregoing description is for a single adsorber stage time period of a total two stage cycle for the system. For the next adsorber stage time period, appropriate valves are operated so that bed 128 begins adsorption and bed 122 begins desorption. Similarly, a new cycle begins after each adsorber stage time period; and, at the end of the two cycle time periods, both beds have gone through the stages of adsorption and desorption.

Makeup hydrogen, as needed, can be supplied, e.g., via line 162. The desorption effluent in line 158 will comprise desorbed normal hydrocarbons, e.g., n-pentane and n-hexane, and hydrogen and light hydrocarbon and other impurities which comprise the purge gas used for desorption. This effluent is reactor feed and is passed to isomerization reactor 160.

The effluent from the reactor 160 flows via line 164. A portion of the reactor effluent is split off of line 164 via line 126 as a hot hydrogen-recycle for feed to the adsorbent bed undergoing adsorption. Up to 100% of the reactor effluent can be recycled in this manner to the adsorbent bed undergoing adsorption. Preferably, at least 10%, and most preferably from 25 to 75% will be recycled. The remainder of the reactor effluent is then passed to heat exchanger 166 where its sensible heat is used to heat the combined hydrocarbon stream in line 112 which includes fresh feed. From the heat exchanger 166, reactor effluent in line 142 is further cooled by air cooler 168 and water cooler 170 prior to separation as discussed above in separator 140.

It is an advantage of the invention that existing TIP equipment can be modified to greatly increase feed throughput and final product production while still providing octane values sufficient for use as a gasoline blending stock.

The following example will help to illustrate and explain the invention, but is not meant to be limiting in any regard. Unless otherwise indicated, all parts and percentages are on a molar basis.

EXAMPLE 1

This example illustrates the operation of a process essentially as shown in FIG. 4. The process design for this example is based on a charge rate of 4000 BPSD of a predominantly $C_5/C_6$ feedstock as described in the Table below, which also describes principal process streams.

TABLE

| Stream Numbers | 110 Fresh Feed (LVN) to Unit | 116 Adsorption Effluent | 124 Total Adsorption Feed | 126 Hot Recycle | 137 Unstabilized Isomerate | 142 Reactor Effluent Takeoff | 158 Desorption Effluent | 162 Make-up Hydrogen |
|---|---|---|---|---|---|---|---|---|
| DESCRIPTION | | | | | | | | |
| State | Liquid | Vapor | Vapor | Vapor | Liquid | Vapor | Vapor | Vapor |
| Temperature °F. | 150 | 500 | 500 | 510 | 100 | 510 | 490 | 100 |
| Pressure, psig | 360 | 242 | 256 | 262 | 220 | 264 | 270 | 220 |
| Molecular Weight | 79.5 | 22.9 | 38.3 | 21.7 | 73.9 | 21.7 | 21.5 | 8.6 |
| Density, Lbs/FT$^3$@ TIP | 38.59 | 0.571 | 1.006 | 0.577 | 38.49 | 0.581 | 0.600 | 0.335 |
| Volumetric Flow Rate, BPSD @ STP | 4000 | — | — | — | 4250 | — | — | — |
| Volumetric Flow Rate, FT$^3$/hr @ TIP | — | 124101 | 123222 | 84243 | — | 125459 | 202335 | 1904 |
| Weight Flow Rate, Lbs/hr | 38580 | 70815 | 124012 | 48595 | 39219 | 72893 | 121488 | 639 |
| | LB Moles/hr | | | | | | | |
| COMPOSITION | | | | | | | | |
| Hydrogen | — | 1732.0 | 1278.5 | 1273.5 | 5.2 | 1910.2 | 3237.4 | 58.9 |
| Methane | — | 490.0 | 370.6 | 362.1 | 8.7 | 543.1 | 901.7 | 5.2 |
| Ethane | — | 87.4 | 69.5 | 63.0 | 7.1 | 94.5 | 155.2 | 4.8 |
| Propane | — | 85.4 | 78.2 | 60.7 | 18.5 | 91.0 | 136.0 | 2.8 |
| Isobutane | — | 86.5 | 92.2 | 60.1 | 33.5 | 90.2 | 117.6 | 0.8 |
| Normal Butane | 2.9 | 17.1 | 65.2 | 38.1 | 8.1 | 57.1 | 90.7 | 0.7 |
| Isopentane | 80.5 | 276.6 | 376.2 | 152.5 | 181.6 | 228.7 | 280.6 | 0.5 |
| Normal Pentane | 125.2 | 32.4 | 304.6 | 88.8 | 23.1 | 133.1 | 324.2 | 0.2 |
| Cyclopentane | 12.5 | 14.5 | 21.2 | 4.1 | 11.1 | 6.2 | 11.7 | — |
| 2.2-Dimethylbutane | 1.8 | 30.3 | 43.4 | 19.3 | 24.2 | 29.0 | 26.3 | 0.4 |
| 2.3-Dimethylbutane | 6.2 | 23.1 | 33.9 | 12.5 | 19.2 | 18.7 | 18.2 | — |

TABLE-continued

| Stream Numbers | 110 Fresh Feed (LVN) to Unit | 116 Adsorption Effluent | 124 Total Adsorption Feed | 126 Hot Recycle | 137 Unstabilized Isomerate | 142 Reactor Effluent Takeoff | 158 Desorption Effluent | 162 Make-up Hydrogen |
|---|---|---|---|---|---|---|---|---|
| 2-Methylpentane | 57.6 | 101.2 | 150.5 | 41.5 | 85.4 | 62.2 | 75.9 | — |
| 3-Methylpentane | 35.5 | 66.9 | 99.6 | 28.4 | 57.0 | 42.7 | 49.6 | — |
| Normal Hexane | 104.1 | 4.7 | 165.9 | 27.0 | 4.1 | 40.6 | 167.6 | — |
| Methylcyclopentane | 24.6 | 27.1 | 41.0 | 7.2 | 23.7 | 10.8 | 18.9 | — |
| Cyclohexane | 10.6 | 10.2 | 15.5 | 2.1 | 9.0 | 3.2 | 6.9 | — |
| Benzene | 13.9 | 9.1 | 13.9 | — | 7.7 | — | 6.2 | — |
| Isoheptane | 3.8 | 3.6 | 5.5 | 0.7 | 3.4 | 1.1 | 2.2 | — |
| Normal Heptane | 5.8 | 0.2 | 12.9 | 2.9 | 0.2 | 4.4 | 12.9 | — |
| Total | 485.0 | 3098.3 | 3238.3 | 2244.5 | 530.8 | 3366.8 | 5639.8 | 74.3 |

A starting point is selected at the discharge stream from the recyle hydrogen compressor 148. This stream is preheated in exchanger 152 against the reactor effluent (Stream No. 142). The hydrogen recycle outlet temperature from 152 is maintained at 358° F., controlling the hydrogen recycle bypass around exchanger 152. The recycle gas is then heated to 510° F. in furnace 154. From 154, the hot hydrogen passes downflow through one adsorber (in this case 128), and strips the adsorbed normals from the molecular sieve adsorbent. Hot desorption effluent (Stream No. 158) is then sent to the isomerization reactor 160. The composition of this stream is shown in the Table.

In the isomerization reactor, the normal paraffins are partially converted to isoparaffins. An improved distribution of isohexanes is also achieved by increasing the concentration of the more highly branched dimethylbutanes. Some ring opening of naphtenes, hydrogenation of aromatics, and cracking of the hydrocarbons to butanes and lighter also occur. The reactor effluent is split, with one stream (Stream No. 126) combining with the adsorber feed, and the other stream of reactor effluent takeoff (Stream No. 142) being cooled by heat exchange against the cold adsorber feed in 166 and against the recycle hydrogen stream 152. The reactor effluent takeoff is further cooled to 140° F. in air cooler 168 and to 100° F. in water cooler 170. It is then sent to the reactor effluent separator 140 for separation of condensed hydrocarbons. The vapor from 140 is routed to the inlet of compressor 148 where it is compressed from 220 to 301 psig. The condensate from 140 is pumped via pump 141 through line 114 and is mixed with the fresh feed stream (Stream No. 110) to form combined hydrocarbon stream in line 112.

The combined hydrocarbon stream 112 is heated against the adsorption effluent (Stream No. 116) in exchanger 118 and against the reactor effluent takeoff in exchanger 166 to the furnace at an inlet temperature of 395° F. In Furnace 120 the combined hydrocarbon stream is heated to 510° F. to provide the required temperature of 500° F. at the adsorber inlet. This feed is then combined with hot recycle in line 126 and to form the total adsorber feed (Stream No. 124) passed upflow through one of two adsorbers (in this case, 122), depending on the position of the cycle, where the normals are adsorbed into the micropores of the molecular sieve adsorbent. Non-normals and a small quantity of displaced hydrogen gas pass through the bed and form the adsorption effluent. The adsorption effluent (Stream No. 116) is cooled against the adsorber feed in heat exchanger 118. It is then air cooled in 132 down to 140° F., and water cooled in 134 down to the temperature of the adsorption effluent receiver 166. The vapor overhead from separator 136 (Stream No. 138) is combined with the vapor overhead from separator 140 and is routed to the inlet to compressor 148. The condensed hydrocarbons from separator 136 form the unstabilized isomerate product. The unstabilized isomerate (Stream No. 137) is sent to stabilization facilities. Hydrogen make-up (Stream No. 162) is supplied as necessary to separator 136.

The two adsorbers (122 and 128) containing molecular sieve adsorbent are both used to separate the normal paraffins from the non-normals in the feedstock. The adsorbers are automatically cycled through sequential steps, by a controller which operates the remote operated valves (ROVs) in the adsorber manifolds (not shown). At any given moment either the two adsorbers are both on the adsorption step or one adsorber is on the adsorption step and one adsorber is on the desorption step. Two cycle timers are set to give the desired step times. The design step times are as follows:

| | |
|---|---|
| Adsorption Step | 110 seconds |
| Desorption Step | 90 seconds |
| Valve Changing | 40 seconds |
| Total Cycle Time | 240 seconds |

The adsorber feed 124 enters the adsorber that is on the adsorption step. The other adsorber is on the desorption step. As the desorption step finishes, the desorption feed is totally bypassed around the adsorbers to the inlet to the isomerization reactor 160. The adsorber that has just finished the desorption step now begins the adsorption step, while the other adsorber finishes the adsorption step. Thus, for a short period of time (20 seconds during valve changes in the four-minute cycle), the two adsorbers are both on the adsorption step.

At the beginning of the adsorption step, the adsorber feed and effluent valves are opening on one bed and closing on the other bed. The adsorber feed, at approximately 500° F. and 256 psia, is fed to the molecular sieve adsorbent bed, which was previously purged with hydrogen. The molecular sieve bed contains synthetic zeolite crystals having interconnecting pores of a precisely uniform size. The pore size of molecular sieve crystals is tailored to accept only molecules with a minimum effective diameter of up to five angstroms. Since the effective molecular diameters of the non-normals in the feed are too large to pass through the pores into the main adsorption sites, only the normals are adsorbed on the bed. The non-normals remain in the void spaces of the bed and displace the purge gas (retained from the previous desorption step) out through the top of the adsorber into the adsorption manifold.

As the adsorption step continues, the non-normals/purge gas interface reaches the top of the adsorber. The composition of the adsorption effluent changes from being mostly purge gas to being mostly non-normals and hydrogen. The adsorber feed continues to pass upflow through the adsorber and the normals continue to be adsorbed on the bed. The quantity of normals adsorbed per unit of molecular sieve (i.e., the loading) approaches an equilibrium level determined by the partial pressure and molecular weight of the normals and by the adsorption temperature. This relationship is illustrated by plotting the isotherms of loading versus partial pressure. The non-normals and hydrogen in the feed, together with some purge gas and a small quantity of normals, pass out of the top of the adsorber into the adsorption effluent manifold. The normals adsorbing in the bed displace about 15 percent of a vessel void volume of purge gas from the micropores. This gas gradually mixes with the non-normals and passes into the adsorption effluent. During the desorption steps, the purge gas establishes a residual loading of normals on the top portion of the adsorber which is in equilibrium with the normals concentration in the vapor. Since the same equilibrium is reached during the adsorption step, the minimum normals concentration in the adsorber effluent is the same as the concentration in the purge gas. As the normals are adsorbed from the incoming adsorber feed, the liberated heat of adsorption creates a temperature front which travels up the bed coincident with the adsorption mass transfer front. The adsorption step is terminated before the mass transfer front reaches the top of the bed (approximately 90 percent bed utilization), thereby preventing a large concentration of normals from breaking into the adsorption effluent and reducing the isomerate purity.

During the beginning of the desorption step, the non-adsorbed $C_4+$ hydrocarbons, retained in the bed after completion of the adsorption step, are countercurrently displaced with hydrogen purge gas. The displaced hydrocarbons, along with some purge gas, pass out of the bottom of the bed to the Isomerization Reactor.

The purge gas then desorbs normals from the adsorbent by reducing the partial pressure of the normals in the vapor phase, thereby shifting the equilibrium loading to a lower value. Normal pentane and hexane concentrations in the purge gas are maintained at low levels to insure efficient desorption of the adsorbed normals. As the desorption step proceeds, the normals loading on the bed declines and the rate at which normals leave the bed decreases. The desorption step is terminated before all the normals have been removed from the bed. The amount removed during each cycle is based on an economic balance between the adsorber bed investment and the purge gas recirculating costs. Following the completion of the desorption step, the desorption feed and effluent valves close and a desorption feed bypass valve opens. This bed then returns to the adsorption step and continues the sequence of steps just described.

In the isomerization reactor, normal paraffins are partially converted to isoparaffins. A higher octane distribution of isohexane is also achieved by increasing the relative concentration of dimethylbutanes. Some ring opening of naphthenes, hydrogenation of aromatics and feed cracking to butanes and lighter also occur. The performance of the reactor (i.e., conversion and yield) is dependent on space velocity, feed composition, operating temperature and hydrogen partial pressure.

The above description is for the purpose of teaching the person of ordinary skill in the art how to practice the present invention and is not intended to detail all of those obvious modifications and variations of it which will become apparent to the skilled worker upon reading the description. It is intended, however, that all such modifications and variations be included within the scope of the present invention which is defined by the following claims.

We claim:

1. A process for upgrading the octane of a hydrocarbon feed containing non-normal hydrocarbon compounds and normal pentane and hexane by a combined isomerization-adsorption process in the adsorber-lead configuration, comprising:

(a) passing an adsorber feed stream comprising hydrogen, reactor hydrocarbon product and said hydrocarbon feed in vapor phase to an adsorber bed having adsorbent and bed void space during an adsorption step, to adsorb normal hydrocarbons from said adsorber feed stream and produce an adsorption effluent comprising hydrogen and non-normal hydrocarbons wherein the bed void space contains a mixture of hydrogen and unadsorbed adsorber feed comprising non-normal hydrocarbons upon completion of said adsorption step:

(b) passing a hydrogen-rich purge gas through said adsorber bed containing adsorbed normal hydrocarbons and a bed void space containing said mixture of hydrogen and unadsorbed adsorber feed comprising non-normal hydrocarbons during a desorption step to desorb normal hydrocarbons and produce a desorption effluent comprising purge gas and normal hydrocarbons;

(c) passing said desorption effluent through an isomerization reactor in vapor phase to convert at least a portion of the normal hydrocarbons in said desorption effluent to non-normal hydrocarbons and produce a reactor effluent comprising purge gas and reactor hydrocarbon product comprising non-normal and normal hydrocarbons;

(d) recycling a portion of said reactor effluent, without substantial cooling thereof, to provide a portion of said adsorber feed;

(e) separating the remaining portion of said reactor effluent into a hydrogen-rich fraction and a hydrocarbon-rich fraction; and (f) recycling at least a portion of said hydrogen-rich fraction to provide a portion of said purge gas.

2. A process according to claim 1 wherein the adsorber feed comprises from 10 to 90 mole percent hydrogen.

3. A process according to claim 2 wherein the adsorber feed comprises from 30 to 65 mole percent hydrogen.

4. A process according to claim 3 wherein the adsorber feed comprises from 45 to 55 mole percent hydrogen.

5. A process according to claim 1 which further comprises recycling said hydrocarbon-rich fraction to provide a portion of said adsorber feed.

6. A process according to claim 1 wherein the separating described in step (e) is accomplished by partially condensing the remaining portion of said reactor effluent.

7. A process according to claim 1 wherein from about 25–75% on a weight basis of said reactor effluent is recycled to provide a portion of said adsorber feed.

8. A process according to claim 1 wherein said adsorber bed and said isomerization reactor are maintained at a temperature of about 500° F.

9. A process for upgrading the octane of a hydrocarbon feed containing non-normal hydrocarbons and normal pentane and hexane by a combined isomerization-adsorption process in the reactor-lead configuration, comprising:

(a) passing a reactor feed comprising hydrogen, said hydrocarbon feed and desorbed normal hydrocarbons through an isomerization reactor in vapor phase to convert at least a portion of the normal hydrocarbons in said reactor feed to non-normal hydrocarbons and produce a reactor effluent comprising hydrogen and reactor hydrocarbon product comprising non-normal and normal hydrocarbons;

(b) passing said reactor effluent as adsorber feed in vapor phase to an adsorber bed having adsorbent and bed void space during an adsorption step, to absorb normal hydrocarbons and produce an adsorption effluent comprising hydrogen and non-normal hydrocarbons wherein the bed void space contains a mixture of hydrogen and unadsorbed absorber feed comprising non-normal hydrocarbons upon completion of said adsorption step;

(c) passing a hydrogen-rich purge gas through said adsorber bed containing adsorbed normal hydrocarbons and a bed void space containing said mixture of hydrogen and unadsorbed adsorber feed comprising non-normal hydrocarbons during a desorption step to desorb normal hydrocarbons and produce a desorption effluent which comprises hydrogen and said desorbed normal hydrocarbons;

(d) recycling a portion of said desorption effluent, without substantial cooling thereof, to provide a portion of said reactor feed;

(e) separating the remaining portion of said desorption effluent into a hydrogen-rich fraction and a hydrocarbon-rich fraction; and (f) recycling at least a portion of said hydrogen-rich fraction to provide a portion of said purge gas.

10. A process according to claim 9 wherein the adsorber feed comprises from 10 to 90 mole percent hydrogen.

11. A process according to claim 10 wherein the adsorber feed comprises from 30 to 65 mole percent hydrogen.

12. A process according to claim 11 wherein the adsorber feed comprises from 45 to 55 mole percent hydrogen.

13. A process according to claim 9 which further comprises recycling said hydrocarbon-rich fraction to provide a portion of said reactor feed.

14. A process according to claim 9 wherein the separating described in step (e) is accomplished by partially condensing the remaining portion of said desorption effluent.

15. A process according to claim 9 wherein from about 25–75% on a weight basis of said desorption effluent is recycled to provide a portion of said reactor feed.

16. A process according to claim 9 wherein said adsorber bed and said isomerization reactor are maintained at a temperature of about 500° F.

17. A process for upgrading the octane of a hydrocarbon feed containing non-normal hydrocarbons and pentane and hexane by a combined isomerization-adsorption process having at least two isomerization catalyst beds, comprising:

(a) passing a first reactor feed, comprising said hydrocarbon feed and hydrogen, through one of said isomerization catalyst beds in vapor phase to convert at least a portion of the normal hydrocarbons in said reactor feed to non-normal hydrocarbons and produce a first reactor effluent;

(b) passing said first reactor effluent as adsorber feed in vapor phase through an adsorber bed having adsorbent and bed void space during an adsorption step to adsorb normal hydrocarbons and produce an adsorption effluent comprising hydrogen and non-normal hydrocarbons wherein the bed void space contains a mixture of hydrogen and unadsorbed absorber feed comprising non-normal hydrocarbons upon completion of said adsorption step;

(c) passing a hydrogen-rich purge gas through said adsorber bed containing adsorbed normal hydrocarbons and a bed void space containing said mixture of hydrogen and unadsorbed absorber feed comprising non-normal hydrocarbons during a desorption step to desorb normal hydrocarbons and produce a desorption effluent comprising hydrogen and normal hydrocarbons;

(d) passing said desorption effluent as second reactor feed through one of said isomerization catalyst beds to convert at least a portion of the normal hydrocarbons in said desorption effluent to non-normal hydrocarbons and produce a second reactor effluent;

(e) separating at least a portion of said second reactor effluent into a hydrogen-rich fraction and a hydrocarbon-rich fraction; and (f) recycling at least a portion of said hydrogen-rich fraction to provide a portion of said purge gas.

18. A process according to claim 17 wherein hydrogen comprises from 10 to 90 mole percent of the first reactor effluent.

19. A process according to claim 18 wherein hydrogen comprises from 30 to 65 mole percent of the first reactor effluent.

20. A process according to claim 19 wherein hydrogen comprises from 45 to 55 mole percent of the first reactor effluent.

21. A process according to claim 20 wherein catalyst bed and an adsorber bed are included within a single vessel.

22. A process according to claim 17 wherein any remaining portion of said second reactor effluent, without substantial cooling thereof, is recycled to provide a portion of said first reactor feed.

23. A process according to claim 22 which further comprises recycling said hydrocarbon-rich fraction to provide a portion of said first reactor feed.

24. A process according to claim 23 wherein from about 25–75% on a weight basis of said second reactor effluent is recycled to provide a portion of said first reactor feed.

25. A process according to claim 17 wherein the separating described in step (e) is accomplished by partially condensing said at least a portion of said second reactor effluent.

26. A process according to claim 17 wherein said adsorber bed and said at least two isomerization catalyst beds are maintained at a temperature of about 500° F.

27. A process according to claim 17 wherein said first reactor feed and said desorption effluent are passed through the same isomerization catalyst bed.

28. A process according to claim 17 in which there are at least two isomerization catalyst beds wherein said reactor feed is continuously passed through at least one of the beds and said desorption effluent is continuously passed through at least one other bed.

29. A process according to claim 17 wherein said first reactor feed is passed through one isomerization catalyst bed and said desorption effluent is passed through another isomerization catalyst bed.

* * * * *